US006341653B1

(12) United States Patent
Firmaniuk et al.

(10) Patent No.: US 6,341,653 B1
(45) Date of Patent: Jan. 29, 2002

(54) JUNK BASKET AND METHOD OF USE

(75) Inventors: Darryl J. Firmaniuk; Piro T. Shkurti; Vitold P. Serafin, all of Calgary (CA)

(73) Assignee: Polar Completions Engineering, Inc., Calgary (CA)

( * ) Notice: Subject to any disclaimer, the term of this patent is extended or adjusted under 35 U.S.C. 154(b) by 0 days.

(21) Appl. No.: 09/459,265

(22) Filed: Dec. 10, 1999

(51) Int. Cl.[7] ..... E21B 23/01; E21B 33/134; E21B 37/00

(52) U.S. Cl. ..... 166/311; 166/99; 166/135; 166/376; 166/381; 294/86.11

(58) Field of Search ..... 166/99, 117, 139, 166/162, 192, 311, 376, 381, 386; 294/86.11, 86.34

(56) References Cited

U.S. PATENT DOCUMENTS

| | | | | | |
|---|---|---|---|---|---|
| 2,645,290 | A | * | 7/1953 | Fortenberry | 166/99 |
| 2,660,250 | A | * | 11/1953 | Gage et al. | 166/99 |
| 2,687,913 | A | * | 8/1954 | Baker | 166/99 X |
| 2,787,327 | A | * | 4/1957 | Pearson | 166/99 |
| 2,834,300 | A | * | 5/1958 | Brock | 166/99 |
| 2,993,539 | A | * | 7/1961 | Baker | 166/99 |
| 3,120,872 | A | * | 2/1964 | Anderson | 166/99 |
| 3,446,283 | A | * | 5/1969 | Baumstimler | 166/311 |
| 3,814,180 | A | | 6/1974 | Oliver | 166/99 |
| 3,885,625 | A | * | 5/1975 | Ahlsone | 166/181 |
| 4,059,155 | A | | 11/1977 | Greer | 166/301 |
| 4,149,594 | A | | 4/1979 | Evans | 166/134 |
| 4,390,064 | A | | 6/1983 | Enen, Jr. et al. | 166/99 |
| 4,420,040 | A | | 12/1983 | Arbasak et al. | 166/70 |
| 4,703,804 | A | * | 11/1987 | Stokes et al. | 166/311 |
| 4,828,026 | A | * | 5/1989 | Nelson | 166/99 |
| 5,163,522 | A | * | 11/1992 | Eaton et al. | 175/58 |
| 5,348,086 | A | * | 9/1994 | Trout | 166/99 |

FOREIGN PATENT DOCUMENTS

CA 676483 12/1963

OTHER PUBLICATIONS

Composite Catalog of Oil Field Equipment and Services, 40$^{th}$ Revision 1992–93, vols. 1 and 2, Published by World Oil a Gulf Publishing Company, Houston, Texas Bowen–Itco Junk Baskets p. 408 Bowen Reverse Circulation Junk Baskets p. 409 Bowen Full–Flow Reverse Circulation Junk Baskets p. 410 Cavins "Multi–Surge" Junk Snatcher p. 597 Cavins Cement Dumps p. 605 Homco Junk Baskets p. 1580 Houston Engineers Inc. H–E Bit Junk Basket p. 1605 Houston Engineers Inc. Jet Junk Basket p. 1606 The Red Baron Junk Subs (Boot Baskets) p. 2836 Triumph–LOR Junk Sub p. 3400.

* cited by examiner

*Primary Examiner*—George Suchfield
(74) *Attorney, Agent, or Firm*—Sheridan Ross P.C.

(57) ABSTRACT

A junk basket comprises a sleeve sized to fit within a well bore. The sleeve has a bore therethrough, an internal latch at its top end for connection to a complementary retrieval tool having an external latch. A basket floor is movable axially in the bore between a first position intermediate the axial length of the sleeve, and a second position resting on a retaining shoulder at the bottom of the sleeve. In a well bore, the basket floor is supported at the first position, preferably on a retrievable bridge plug, and debris is collected in the defined volume above the floor. When the basket is lifted during retrieval, the basket floor falls to the second position, increasing the collection volume, loosening the debris and loosening the basket in the well bore for ease of retrieval. Further, a novel method of jointly deploying a junk basket and bridge plug results. The basket is connected to the plug and a setting/insertion tool passes through the basket's bore and through a port in the basket floor. Once the plug is set in the well bore the setting tool is removed. By lifting the retrieving tool with a predetermined load over string weight, the basket is sheared from the plug, a ball engages the port in the floor and the floor falls, loosening the debris and basket in the well bore.

18 Claims, 9 Drawing Sheets

10
76
70
72
71
75
74
73
12
V
11
13
50

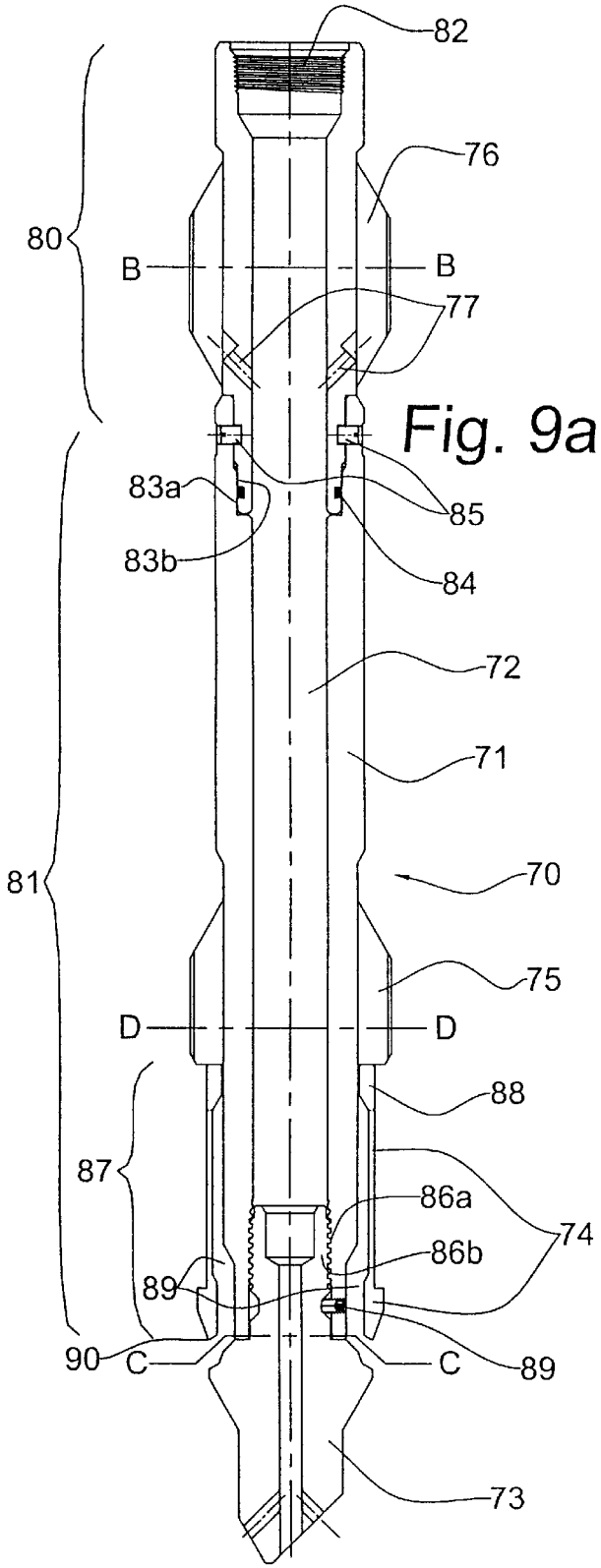
Fig. 9a
Fig. 9b
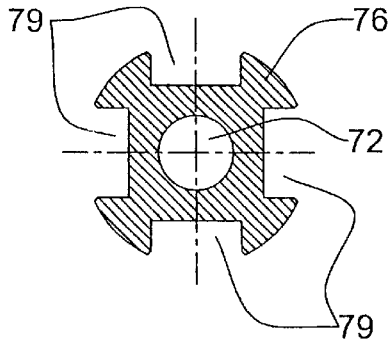
Fig. 9c
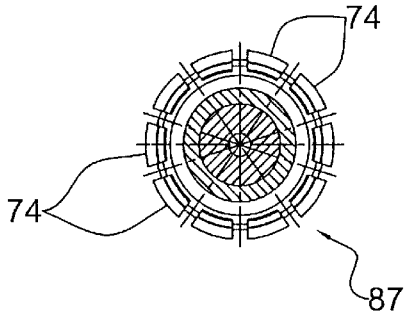
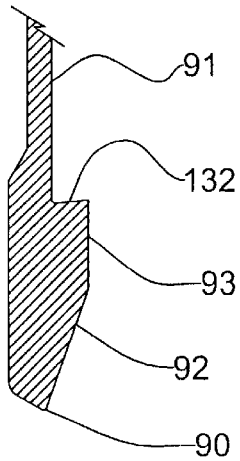
Fig. 9d

JUNK BASKET AND METHOD OF USE

FIELD OF THE INVENTION

The present invention relates to apparatus and methods for collecting debris so as to protect a well bore and its contents during well bore operations, such as perforating the well. Particularly, a junk basket is disclosed which is run into the well bore atop a bridge plug.

BACKGROUND OF THE INVENTION

After casing is placed in a well bore, various operations can be performed. Workover operations, including perforation of the casing produce significant quantities of debris. It is usually desirable to isolate those portions of the well which are not being worked on. Where the unaffected zones are lower in the well bore, a bridge plug is run in and set in position below the intended work zone and above the zone to be protected. A junk basket is subsequently placed on, or above, the bridge plug to collect debris generated from the operation.

For instance, in the case where hydraulic fracturing of a formation is performed at an upper set of perforations in the casing, in a first trip, a retrievable bridge plug is set below the upper perforations to block the lower well bore. A setting tool is run in from the surface carrying the bridge plug. An insertion rod associated with the setting tool is attached to, and holds, the plug in position while an outer sleeve of the setting tool imparts a downward force, setting the sealing elements and slips. Then, a link is sheared to separate the insertion rod from the plug. In a second trip, a junk basket is lowered to sit atop the set bridge plug. The workover operation is performed. Frac balls or ball sealers are often used in fracturing so as to gravitate to and temporarily block some perforations for better distribution of fracturing fluid and proppant. Ball sealers must be later removed or they become a significant nuisance. After the workover, in a third trip, a cleanout tool is run into the hole, circulating fluid for washing light debris away from the top of the junk basket and carrying it uphole for removal at the surface. In a fourth trip, a retrieving tool is run in which includes a fish for attaching to the junk basket and fishing it out of the well.

The junk basket typically contains debris including particulate matter (sand) and ball sealers. As required for the particular instance, a fifth trip may be expended to retrieve the bridge plug.

In summary, without including additional trips resulting from experiencing problems, a least five trips are performed: run in and set the bridge plug; run in junk basket; cleanup well bore to junk basket, retrieve junk basket, retrieve the bridge plug.

Each run in operation and trip out costs time and correspondingly, money. Beside the number of trips, several difficulties are associated with the above-described conventional operation. As the diameter of a junk basket is necessarily close to that of the casing to which it is fitted, the sand from the workover tends to pack between the junk basket and the casing, binding and generally making it difficult to pull the basket during retrieval. Additional difficulties are associated with the means for retrieval. As stated, junk baskets fit closely within the well casing. It is known with conventional baskets to use a central and upward projection or fish-neck. To maximize basket capacity, the fish neck diameter is minimized. The retrieval tool must locate and connect to the fish-neck, however it must do so without laterally deflecting it and bending it, which jeopardizes chances of retrieval. Another problem with the conventional baskets is the lack of reliable feedback which enables the operator to ascertain when the fish has actually latched onto the junk basket. Baskets are light and are not normally detected. Many a trip out is performed to find nothing on the end of the retrieving tool, requiring one or more additional fishing trips.

For addressing both economics and reliability issues, there is a need for an improved junk-basket and means of installing and retrieving same.

SUMMARY OF THE INVENTION

A novel junk basket is provided and a method of operation, which in a preferred form, is attached to a bridge plug with shear pins and set simultaneously therewith, thus requiring only a basket/plug setting step, a basket retrieving step shearing the pins, and a plug retrieving step; not the five or more steps of the prior art. Further, the preferred basket maximizes debris capacity, makes fishing retrieval more reliable, latching of the basket is positively identified and the basket is more easily withdrawn from a cased well bore.

The preferred apparatus is a basket having a tubular sleeve with a substantially open bore therethrough, the sleeve fitting closely in the casing. The top end of the basket forms a robust internal latch and adjacent the top end are fluid slots to the casing. The basket has a bottom or floor which is movable in the bore but cannot escape the basket's bottom end. In the well bore, the basket floor is supported by a protuberance such as the bridge plug thereby spacing the floor upwardly in the basket bore. Once filled with debris and latched with a retrieving tool, the junk basket is lifted upwardly from the protuberance causing loss of support for the floor and allowing it to fall to the bottom of the basket where its fall is arrested, but not before the volume within the basket is suddenly increased for the loosening of the collected debris in the basket and loosening of the packed debris between the sleeve and casing through the slots, and thereby aiding in recovery.

In a broad apparatus aspect then, a junk basket for collecting debris comprises:

- a tubular sleeve which fits within a well bore, the sleeve having a bore extending axially therethrough and having top and bottom ends;
- an internal retrieving latch formed at the top end of the sleeve;
- a basket floor for substantially blocking the sleeve's bore and being axially movable therein;
- an internal shoulder formed within the sleeve's bottom end for supporting the basket floor preventing its passage downwardly therethrough, the basket floor being operative between at least two positions being,
  - (1) a first collection position wherein basket floor is supported and spaced somewhat upwardly from the sleeve's bottom end for forming a collection volume for collecting debris, and
  - (2) a second retrieving position wherein the basket floor falls to the internal shoulder when the junk basket is lifted by a retrieving device, thereby increasing the collection volume and whereby the collected debris is loosened within and outside the sleeve permitting ease of retrieving.

Preferably the basket floor is supported on a bridge plug anchored in the well bore. More preferably, the sleeve is attached to the bridge plug with shear pins so that, once the retrieving latch is engaged, then at predetermined weight of a retrieving string, the pins shear and the operator is clearly aware the basket was caught and will be retrieved.

More preferably, the basket floor is formed with an axial port so an insertion rod can be connected to the bridge plug through the floor, the basket thereby being capable of being run in with the bridge plug and does not interfere with the setting of the plug. Provision for axial slots through the sleeve permits fluid communication with the casing annulus which can aid in the retrieval process.

The above apparatus enables a novel method of setting and retrieving a bridge plug and junk basket simultaneously.

In a broad method aspect then, a downhole tool, such as a bridge plug is deployed simultaneously with a junk basket using a setting tool and insertion rod, the downhole tool having a top protuberance comprising the steps of:

connecting a junk basket to the top of the downhole tool, the junk basket having a tubular sleeve with top and bottom ends, an open bore extending axially through from the top end through to the bottom end, and having a basket floor which blocks the sleeve's bore, the insertion rod passing through the sleeve's bore and to an axial port in the basket floor, and a ball which is movable within the sleeve's bore and is capable of blocking the axial port;

releasably connecting the insertion rod to a rod connection at the top protuberance through the sleeve's bore;

inserting the insertion rod, junk basket and downhole tool into the well bore;

setting the downhole tool to anchor it within the well bore; and releasing the insertion rod from the rod connection so that the junk basket remains in the well bore above the downhole tool and the ball is able to block the axial port.

Preferably, the sleeve has one or more fluid ports for communication between its bore and the well bore and basket floor is movable within the sleeve's bore and initially spaced upwardly by the protuberance so that when the basket is retrieved, the ball is blocking the axial port and the floor drops, increasing the basket volume and loosening debris within and outside the basket. More preferably, the basket's sleeve is attached to the downhole tool with shear pins for enabling confirmation of the latching of a retrieval tool and thus completing the method for deploying, collecting debris and retrieving the debris.

BRIEF DESCRIPTION OF THE DRAWINGS

FIG. 2*a* illustrates setting the bridge plug and junk basket, using the junk basket as a setting sleeve;

FIG. 2*b* illustrates the junk basket on the bridge plug after removal of the setting tool;

FIG. 9*a* is a cross-sectional view of the retrieval device complete with upper and lower centralizer subs, a cleanout nozzle and collet supporting latch fingers;

FIG. 9*b* is a cross-sectional view along section lines B—B of FIG. 9*a* illustrating the hollow mandrel having a fluid bore and annular cleanout passages;

FIG. 9*c* is a cross-sectional view along section lines C—C of FIG. 9*a* illustrating the individual finger latches of the collet; and FIG. 9*d* is a partial cross-sectional view of the tip of a finger latch.

DETAILED DESCRIPTION OF THE PREFERRED EMBODIMENT

Figure 1:
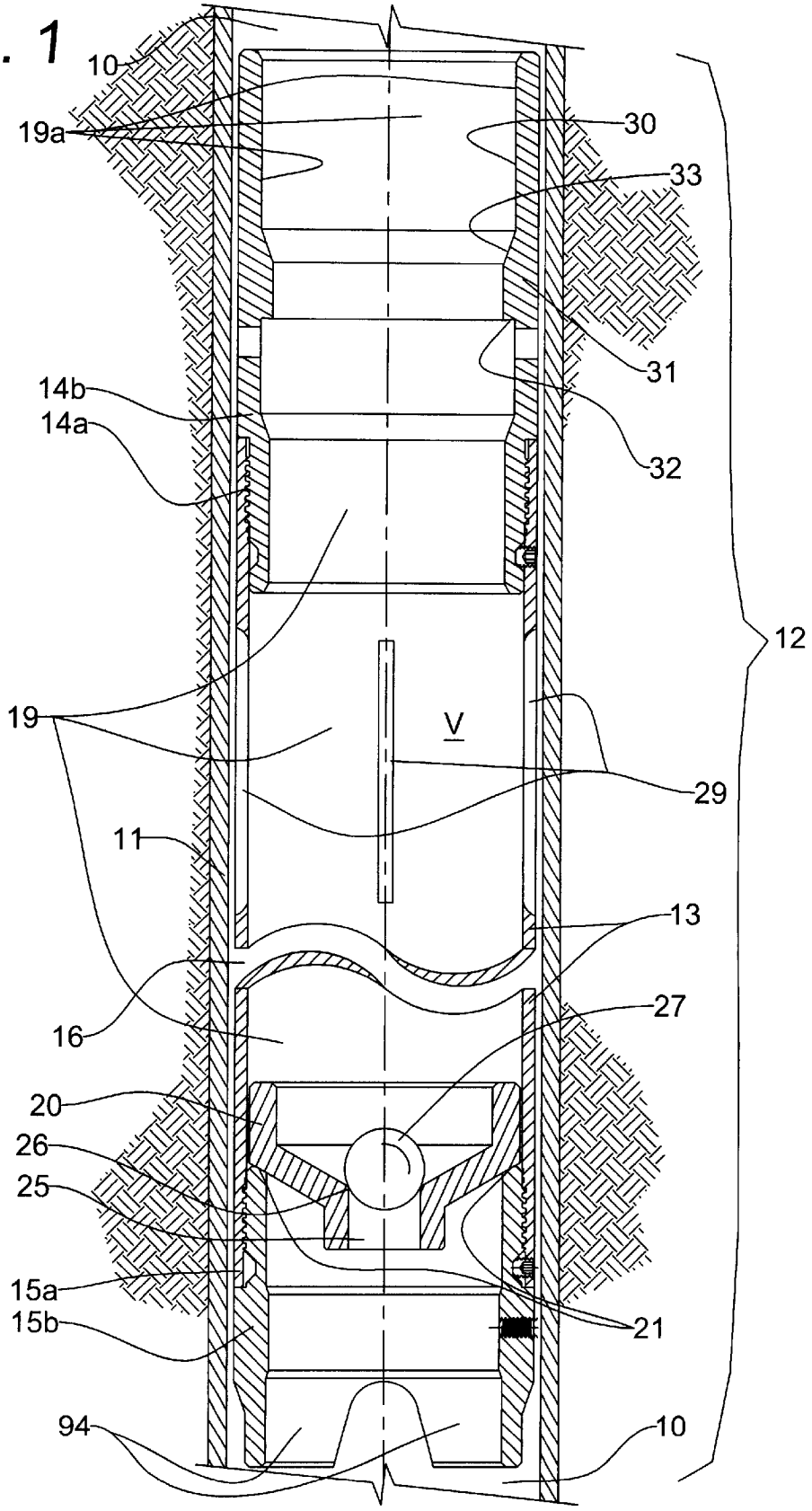
FIG. 1 is a cross-sectional, axially compressed view of a junk basket according to one embodiment of the present invention.
Figure 2A:
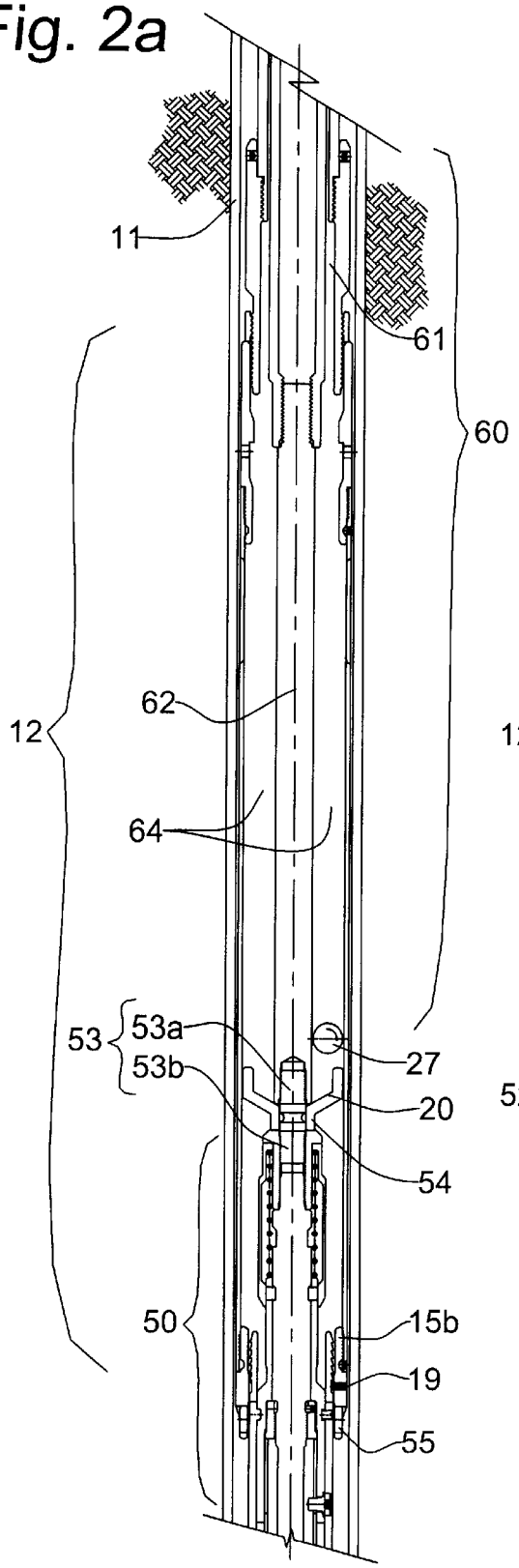
FIGS. 2*a*–2*b* are cross-sectional views of the junk basket accordingly to FIG. 1, with and without the setting tool assembly. More specifically.

Having reference to FIGS. 1 and 2*a*, a well bore 10 is shown which is going to have some sort of workover performed intermediate along the well bore. The well bore 10 has a casing 11, a bridge plug 50 (FIG. 2A) and a junk basket 12 installed for collecting debris above the plug 50. The term "well bore" is sometimes used herein as a more general term for the bore of the casing 11. The preferred embodiment is described in the context of a workover comprising a hydraulic fracturing operation which utilizes ball sealers. The presence of ball sealers is instructive in illustrating the ability of the invention to deal with a variety of debris. Applicant is not restricting use of the invention to fracturing operations, but the operation is merely used for best illustrating the present invention.

The junk basket 12 is positioned above the bridge plug 50 using a process described later. The basket 12 comprises a cylindrical sleeve 13 having a top end 14*a* and a bottom end 15*a*. The sleeve 13 fits closely within the casing 11, forming a narrow casing/sleeve annulus 16. A top sub 14*b* is threaded onto the sleeve's top end 14*a* and a bottom sub 15*b* is threaded onto the sleeve's bottom end 15*a*. A contiguous bore 19 extends through the top sub 14*b*, sleeve 13 and bottom sub 15*b*.

At the top of the sleeve 13, adjacent to the top sub 14*b*, axial slots 29 (four shown) are provided for permitting fluid communication between the sleeve's bore 19 and the casing annulus 16. The slots are sized to permit fluid communication but exclude large debris.

The basket 12 has a movable floor 20 preferably formed of a funnel-shaped body which fits closely within the sleeve's bore 19. The basket floor 20 is axially slidable within the bore 19 for varying the volume V within the bore 19 of the sleeve 13. An internal upset within the bottom sub 15*b* forms an inward internal shoulder 21 which projects sufficiently into the sleeve's bore. 19 to prevent exit of the basket floor 20. In FIG. 1, the basket floor 20 is shown resting on the bottom sub's internal shoulder 21. In FIG. 2*a*, the basket floor 20 is shown spaced upwardly intermediate the sleeve's bore.

The basket floor 20 has an axial, centralized port 25 and ball seat 26. A ball 27 is provided which is movable within the sleeve's bore 19 and which is operative to seat on the ball seat 26 and block the axial port 25. The ball 27 is only operative at a defined point in the operation of the junk basket as described in greater detail later.

The top sub 14*b* (FIG. 1) is adapted for engaging a retrieving tool 70 (FIGS. 9*a*–9*d*). The retrieving tool 70 is provided for the eventual retrieval of the junk basket 12 (See sequential FIGS. 4*a*, 4*b*, 7*a* and 7*b*).

Referring then to FIGS. 1, 5*a*–5*c*, and 9*d*, the top sub 14*b* and retrieving tool 70 have complementary latching shoulders 32, 132. For enabling the engagement of the retrieving tool 70, the top sub 14*b* comprises a wide mouth 19*a*. Downhole from the mouth 19*a*, the top sub's bore 19 progressively narrows for forming an internal shoulder 31. The uphole end of the shoulder 31 forms a ramp 33 for guiding and easing the entry of the complementary retrieving tool 70. A bottom face of the shoulder 31 is angled perpendicularly for forming the top sub's internal latch 32.

As an assembly, the sleeve 13, bottom sub 15*b*, basket floor 20 and ball 27 form the volume V for the collection of debris.

Figure 2B:
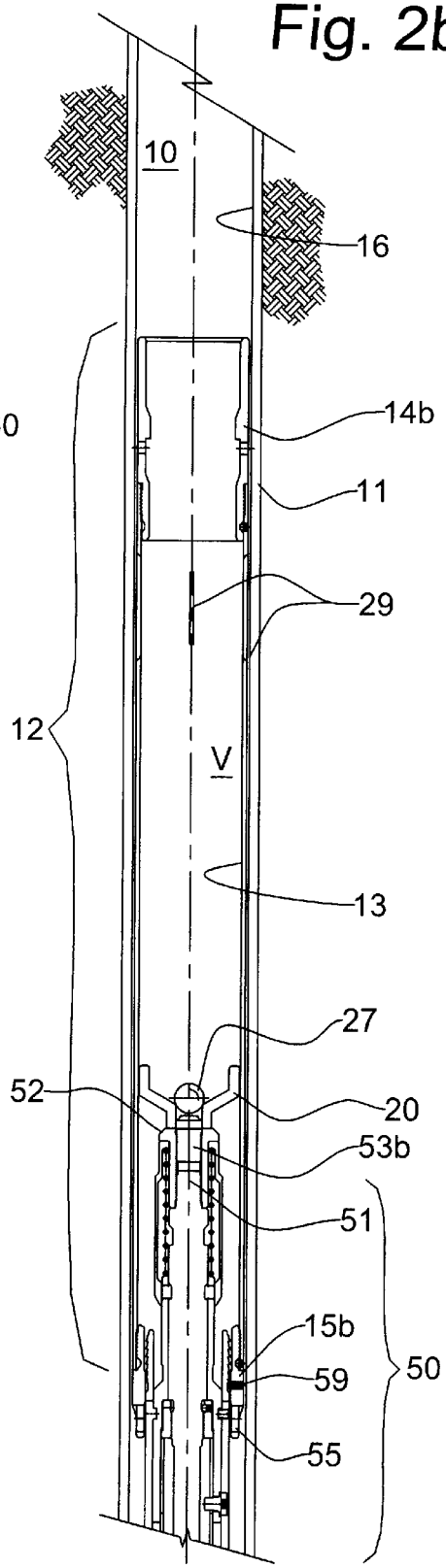

Accordingly, referring to FIGS. 2*a*, 2*b*, the junk basket 12 is supported in the well bore 10 by the bridge plug 50. The bridge plug 50 is utilized to separate the well bore into a lower isolated zone and an upper working zone. Preferably the bridge plug is retrievable, providing maximum flexibility in the resumption of well operations after the workover. The bridge plug 50 is anchored in the well bore 10 and actuated for sealing the casing 11. Besides anchoring slips and sealing elements (not shown), the plug 50 comprises a mandrel 51 having an axially extending protuberance 52 which incorporates a central shear stud 53 having a weakened neck portion 54. Positioned near the top of the plug's mandrel 51 are laterally projecting setting and retrieving load-bearing lugs 55.

The junk basket 12 is connected to the plug's top protuberance 52. The bridge plug's top protuberance 52 extends into the bore 19 of the bottom sub 15*b* until the bottom sub bears against the retrieval lugs 55. The bottom sub 15*b* is retained to the bridge plug using two brass set shear pins 59 having a known shear load—typically 1000 lbs. each. To decouple the basket 12 and plug 50, the basket 12 is loaded in tension relative to the anchored plug 50 until the brass pins 59 shear.

When coupled, the basket floor 20 rests against the plug's protuberance 52 under its own weight. The protuberance 52 causes the floor to be spaced upwardly in the sleeve's bore 19, above the top protuberance 52. The axial port 25 in the floor 20 is sized to accept and pass the plug's shear stud 53 therethrough.

The structure of the junk basket 12 enables unique setting, debris collection and retrieval.

Setting Tool Assembly

Best seen in FIG. 2*a*, a setting tool assembly 60 is provided comprising both a setting tool 61 and a slender insertion rod 62. The setting tool assembly 60 is used for conveying the bridge plug 50 into the well bore 10 and then setting or deploying it in the casing 11. The assembly 60 is typically connected to the end of coiled tubing or electric wireline (neither shown) which is run in the well bore 10. The assembly's insertion rod 62 is positioned at the lower end of the setting tool assembly 60 and projects through the bore 19 of the junk basket's top sub 14*b* and through the sleeve 13 to connect to a rod connection of the plug, such as the shear stud 53, typically by threaded connection.

An annular space 64 is formed in the sleeve's bore 19 between the insertion rod 62 and the sleeve 13. The ball 27 is movable within the annular space 64. The ball 27 cannot achieve a central position over the axial port 26 of the basket floor 20 due to the presence of the assembly's insertion rod 62.

The setting tool 61 causes the basket's sleeve 13 and bottom sub 15*b* to bear down on the plug's lateral lugs 55, setting the plug's anchoring slips and sealing the plug 50 in the casing 11. During setting of the plug, the insertion rod 62 remains fixed to the setting tool 61, resulting in relative movement between the insertion rod 62 and the lateral lugs 55.

Once the plug 50 is set, further downward load on the basket causes an ever increasing tensile load on the insertion rod 62 until the stud 53 shears and separates at the neck 54 into an upper portion 53*a* above the neck for removal from the well bore 10 with the insertion rod and a lower portion 53*b* which remains with the plug 50. The top protuberance 52 continues to support the basket floor 20 even after the stud 53 is sheared. Means for actuating the relative movement of the setting tool 61 and insertion rod 62 are known in the art and have not been described in detail.

Retrieving Tool

The retrieving tool 70 is connected to the bottom of a coil tubing string (not shown) which is run into the well bore 10 for engaging and retrieving the junk basket 12.

As detailed in FIGS. 9*a*–9*d*, the retrieving tool 70 comprises a hollow mandrel 71 comprising a fluid bore 72, a cleanout nozzle 73, finger latches 74, a lower centralizer 75, an upper centralizer 76, and lift jets 77. Typically, air is used as the cleanout fluid. The fluid bore 72 conducts sufficient air flow for discharge from the nozzle 73 to fluidize, elutriate and carry light or fine debris, such as sand, up the casing 11 for removal from the well bore 10 at the surface. As shown in FIG. 9*b*, the upper and lower centralizers have axial ports 79 formed about their periphery for passing the cleanout fluid and debris up the well bore 10 The lift jets 77 are directed upwardly and outwardly to aid in lifting debris up the well bore 10.

The mandrel 71 is an assembly having a top centralizer sub 80 and a lower centralizer sub 81. The top centralizer sub 80 has an upper threaded socket for connection to tubing string and a lower male pin end 83*a*. The upper centralizer 76 is formed onto the top centralizer sub 80. The lower centralizer sub 75 has a female socket 83*b* for accepting the top centralizer sub's male in end 83*a*. A ring seal 84 seals the pin end 83*a* and socket 83*b* with shear screws 85 retaining them together. The shear screws 85 provide a safety disconnect and shear at loads greater than the anticipated working loads and those necessary to shear the sleeve-to-plug pins 59, typically about 10,000–15,000 lb. force.

The bottom end 86*a* of the lower centralizer sub 81 is threaded for adapting to a complementary threaded male connection 86*b* on the cleanout nozzle 73.

Best seen in FIGS. 9*a* and 9*c*, the finger latches 74 are formed by a collet 87 comprising a ring collar 88 having a plurality of independent longitudinally extending finger latches 74. The ring collar 88 fits slidably over the lower centralizer sub 81 forming a latch deflection annulus 89 therebetween. The deflection annulus 89 has sufficient clearance to permit tips 90 of the finger latches to be deflected radially inwardly by the basket's top sub shoulder 31, bending elastically at the collar 88.

As detailed in FIG. 9*d*, the profile of the finger latches 74 is complementary to that of the basket's top sub 14*b*. Each finger has an outward facing latch 91 formed at its tip 90. The tip 90 of each finger 74 thickens upwardly and ramps radially outwardly, forming an outward facing ramp 92 and shoulder 93. At the upper end of the shoulder 93, a top face 132 is angled perpendicularly inward for complementary latching with the top sub latch 32.

The greatest radial extent of the shoulder 93 in the undeflected state is about that of the bore of the basket's top sub below the top sub shoulder 31. When engaged, the top face 132 of the finger latches 74 positively engage the internal latch 32 of the top sub 14*b*.

The lower centralizer 75 and latch collet are fitted over the lower centralizer sub 81 before connection of the cleanout nozzle 73. When the cleanout nozzle 73 is threaded into the bottom of the hollow mandrel 71, it retains the lower centralizer and collet 87 onto the mandrel 71.

The cleanout nozzle 73 comprises two jets which are contiguous with the fluid bore. The nozzle's jets are directed generally downwardly for engaging and loosening debris. Provision of two or more jets avoids complete loss of circulation of one jet becomes blocked.

The operation of the junk basket 12 can be described as having three basic stages; running in, collection of debris, and retrieval. These three operations are accomplished in only two trips.

Running In

To run in the basket 12, it is first assembled with the bridge plug 50, the result being illustrated in FIG. 2*a*. The basket 12 and plug 50, the bottom sub 15*b* is inserted over the plug's protuberance 52. Tangs (not shown) depending from the bottom of the bottom sub engage the lugs 55. The shear stud 53 is installed into the plug's protuberance 52. The basket floor 20 is placed over the shear stud 53. The setting tool assembly's insertion rod 62 is threaded onto the shear stud 53. The sleeve 13 is threaded into the bottom sub 15*b*. The ball 27 is inserted into the annulus 64 between the insertion rod 62 and the sleeve 13. The top sub 14*b* is threaded onto the sleeve 13. The setting tool 61 is threaded onto the insertion rod 62. An adjustment on the setting tool 61 takes up slack between the setting tool 61, the sleeve 13, bottom sub 15*b* and the plug's lugs 55. When the top sub 14*b*, sleeve 13 and bottom sub's tangs (not shown) are sandwiched tight between the setting tool 61 and the plug 50, the brass shear screws 59 are installed into the sleeve's bottom sub 15*b*.

The junk basket 12, bridge plug 50 and setting tool assembly 60 are attached to lowering means such as a tubing string (not shown). The tubing string is inserted into the well bore 10 to the desired setting depth (FIG. 2*a*). The setting tool 61 is actuated for setting or anchoring the plug 50 in the well bore 10 by imparting opposing forces on the plug 50 and shear stud 53, downward through the basket 12 against the plug's setting lugs 55 and through the shear stud 53. Once set, the stud 53 is sheared for separating the insertion rod 62 from the plug 50.

The setting tool 61 and insertion rod 62 are removed from the well bore 10, leaving the basket 12 and bridge plug 50 in the well bore 10 (FIG. 2*b*). The sleeve's bore 19 is wide open for accepting debris 100 with the basket floor 20 spaced somewhat upwards from the bottom of the basket 12 by the plug's top protuberance 52.

Collection of Debris

Figure 3A:
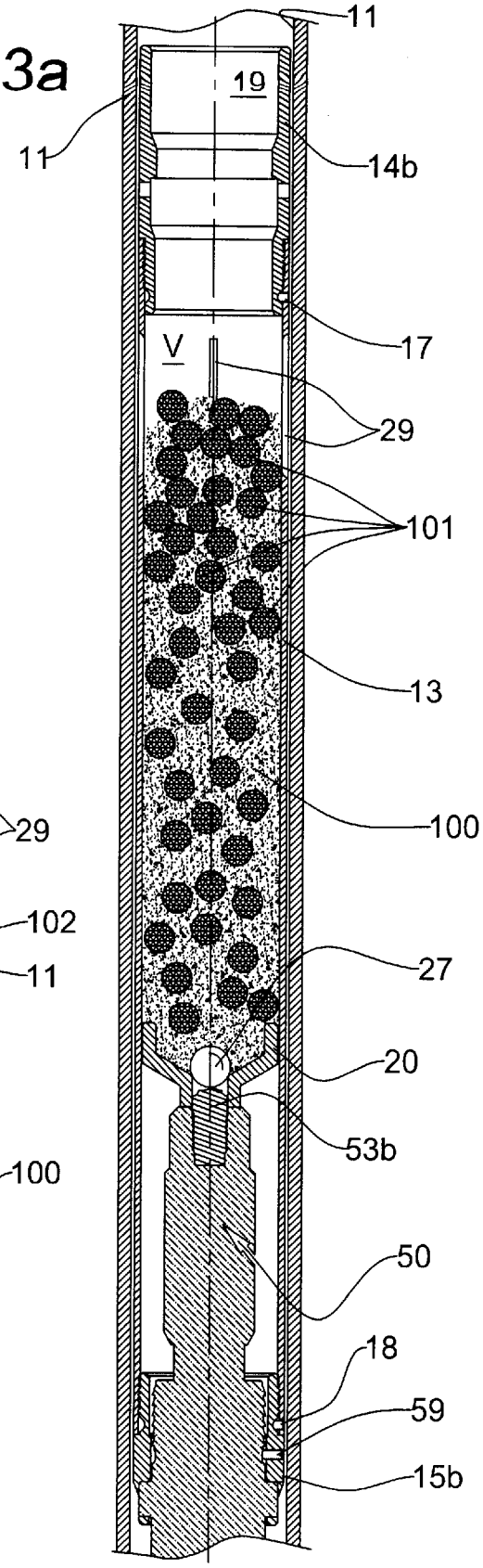
FIG. 3*a* is a cross-sectional view illustrating the collection of debris in the junk basket, including ball sealers, the bridge plug detail is omitted to clarify the junk basket components.
Figure 3B:
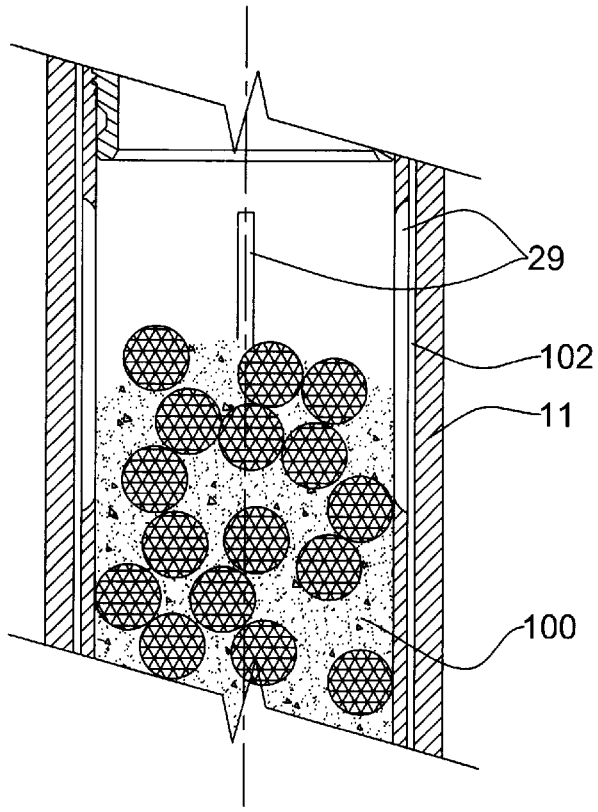
FIG. 3*b* is a close-up of the slot area according to FIG. 3*a* illustrating packing of sand between the sleeve and casing.

As shown in FIG. 3*a*, during a workover, debris 100 falls through the basket's top sub 14*b*, into its bore 19 and enters the basket's collection volume V. The sleeve 13 fits quite closely to the well bore casing 11 and thus most debris 100 enters the basket 12. The debris includes fines, like sand, and larger debris, like ball sealers 101. As shown in FIG. 3*b*, sand can settle in the very small annulus 102 formed between the sleeve 13 and the well bore 10.

The amount of debris 100 usually exceeds the volume of the collection volume V, filling it to above the top sub 14*b* and continuing to pack in the well bore 10 thereabove.

Retrieving

Having reference to FIGS. 4*a*–6, in order to engage and latch the retrieving tool 70 into the basket's top sub 14*b*, some of the debris 100 which has accumulated on top of the basket 12—such as packed sand—must be cleared both from above and within the upper portion of the top sub 14*b* of the junk basket 12. Accordingly, the retrieving tool 70 is run into the well bore 10 on a tubing string.

Figures 4A, 4B:
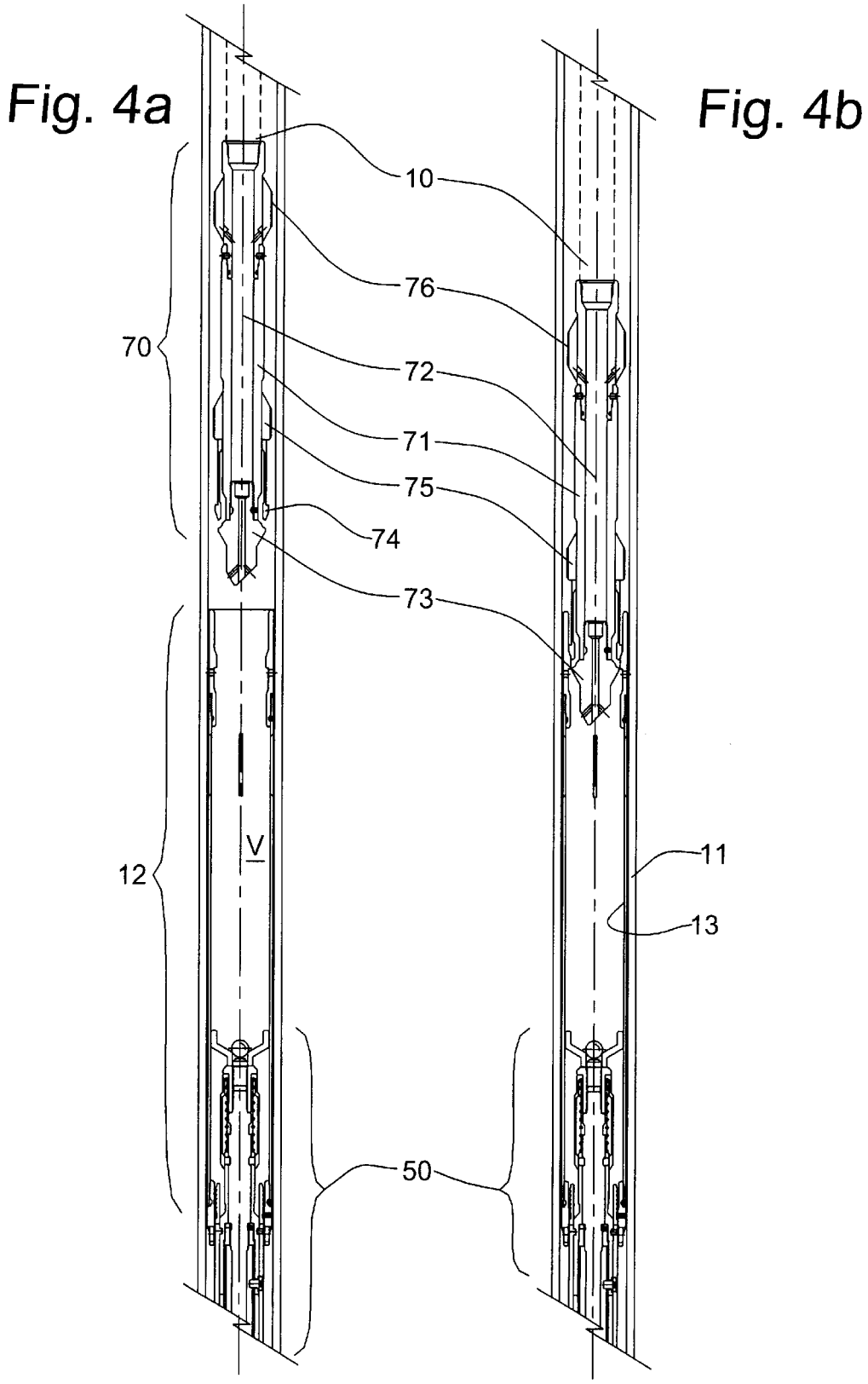
FIG. 4*a* is a cross-sectional view illustrating a retrieval tool inserted into a well bore, just above the junk basket (no debris is shown)
FIG. 4*b* is a cross-sectional view illustrating the retrieval tool with the mandrel engaging the shoulders of the junk basket while collapsing the latch fingers radially inwardly, before actually latching (no debris is shown)
Figure 6:
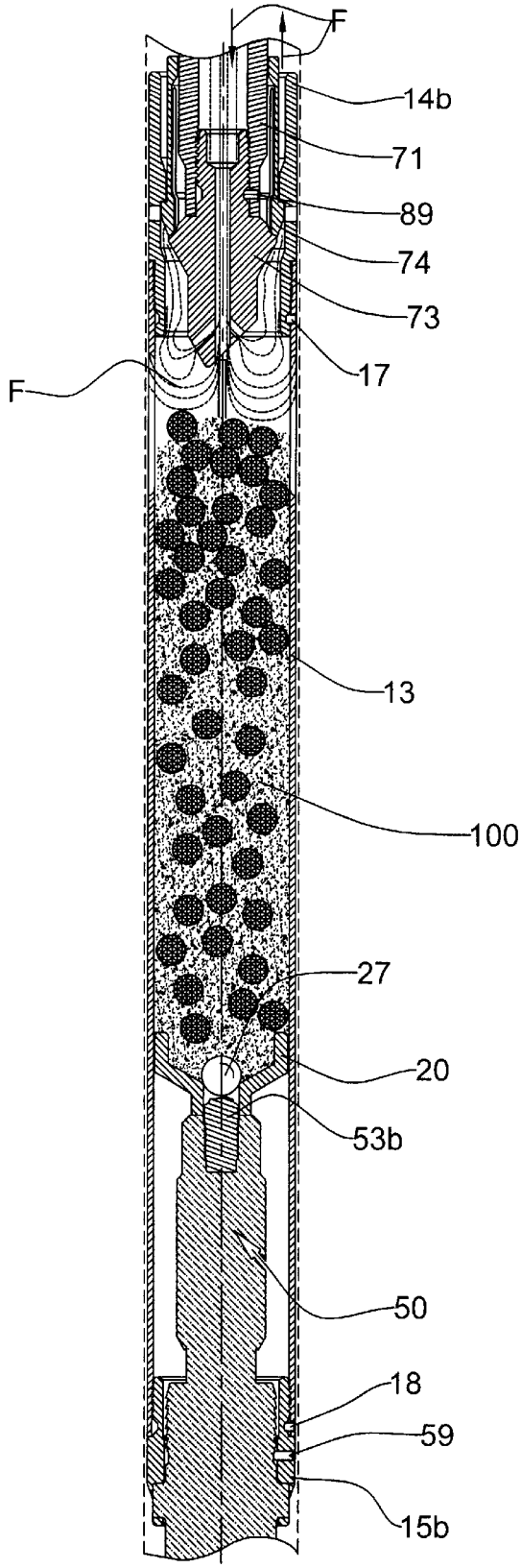
FIG. 6 is a cross-sectional view illustrating a debris-filled junk basket with the basket's ball in place in the basket floor's port. Cleanout fluid flow is shown lifting fine debris upwardly past the retrieving tool's lower centralizer.

Having reference to FIGS. 4*a*, 6 cleanout fluid F is pumped down to the retrieving tool 70 and nozzle 73 for fluidizing lighter gravity debris 100 that may be in the well bore 10 and basket. FIG. 6 illustrates the conclusion of the debris cleaning operation. The velocity and viscosity of the fluid F is sufficient to carry the lighter debris 100 up the well bore 10, past the retrieving tool, through the centralizer ports 79 and to the surface. Some fluid F will pass through axial slots and up the casing annulus 16 and around the top sub 14*b*.

Heavier components of the debris 100, like solid ball sealers 101, are too heavy to be fluid lifted to the surface nor can they pass through axial slots 29, nor past the lower centralizer, and thus concentrate in the collection volume V of the basket 12.

Figure 5A:
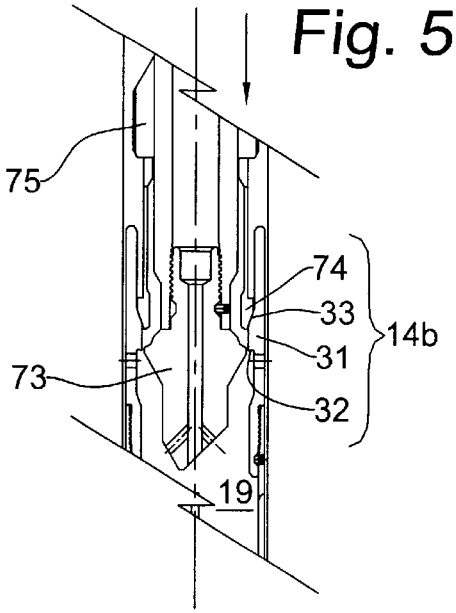
FIGS. 5*a*–5*c* are detail partial views of the latching of the retrieving tool with the top sub before, after setting down with tubing weight and during lifting respectively.
Figure 5B:
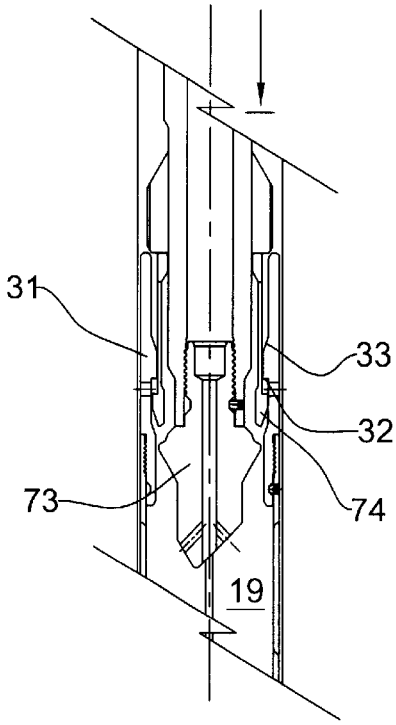
Figure 5C:
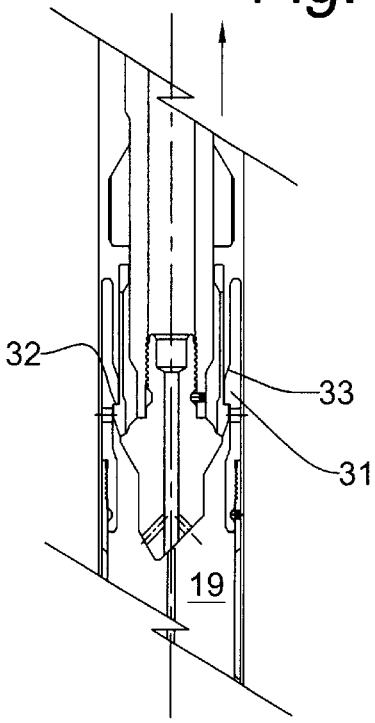

Having reference more specifically to FIGS. 5*a*–5*c* and 9*d*, as the retrieving tool 70 reaches the top sub 14*b*, the ramp 92 of the tapered fingers 74 contact the inside ramp 33 of the top sub 14*b* (FIG. 5*a*). Set down weight on the retrieving tool 70 causes the ramps 92 of the latch fingers 74 to ride on the top sub ramp 33, collapsing the finger latches radially inwardly, allowing the latch fingers 74 to slide into the top sub 14*b* until the upward facing, outward facing latch 132 of the latch fingers pass the downward facing inside shoulder 31 of the top sub 14*b*. The lower centralizer 75 is seen to contact the top sub, arresting the retrieving tool (FIG. 5*b*). The finger latches 74 expand inside the top sub 14*b* and when the retrieving tool is again lifted (FIG. 5*c*), the outside shoulders 132 of the finger latch 74 catch the top sub's inside shoulder 32, positively engaging the retrieving tool 70 to the basket's top sub 14*b*. The latched condition is shown in FIG. 6.

Figure 7A:
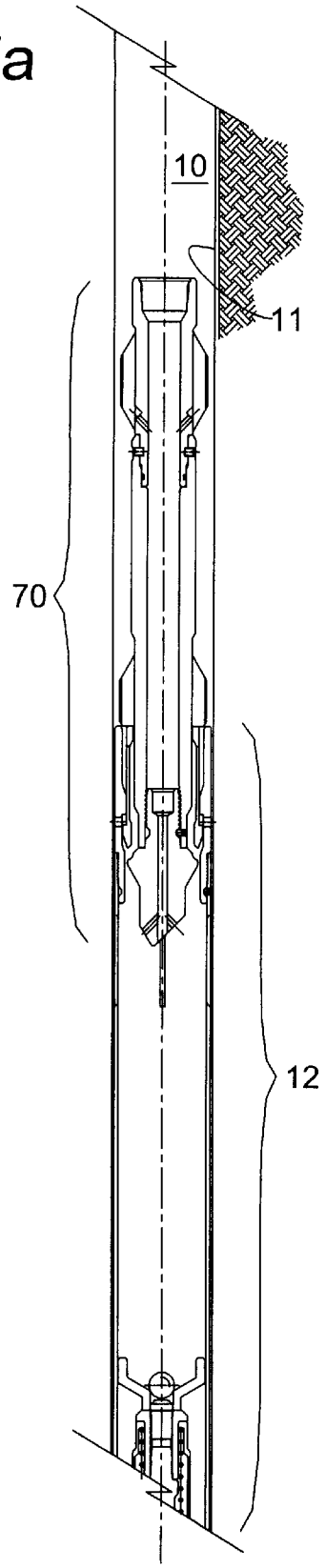
FIG. 7*a* is a cross-sectional view illustrating the retrieval tool positively engaged with the junk basket having upward facing, outside shoulders of the latch finger's shoulders catching inside shoulders of the basket's top sub (no debris is shown)
Figure 7B:
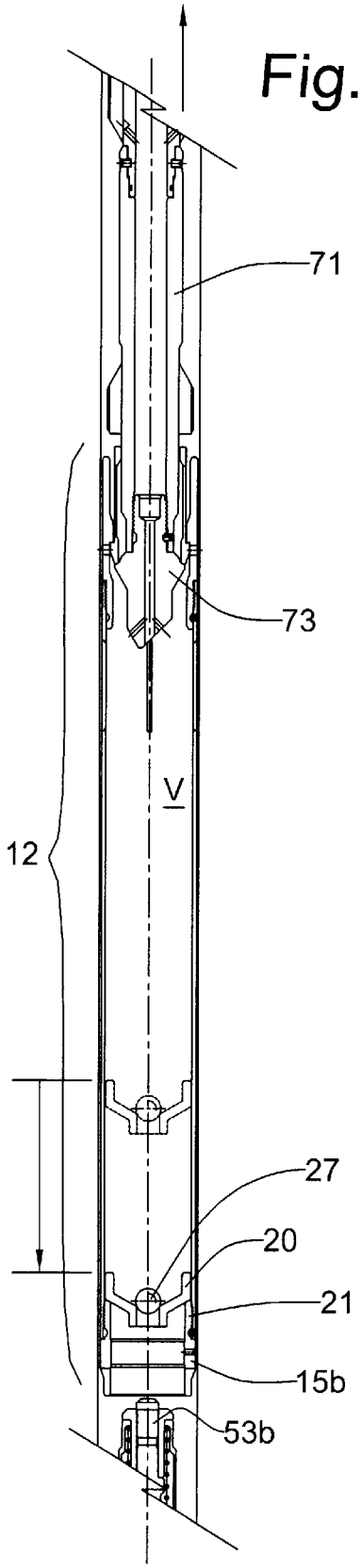
FIG. 7*b* is a cross-sectional view illustrating commencement of retrieval by shearing of the junk basket from the bridge plug, dropping the basket floor of the basket for rapid loosening of the debris therein and packed therearound (no debris is shown)

At any time thereafter, once an operator believes the retrieving tool 70 has reached the top sub 14*b*, the operator can positively determine whether the tool 70 has latched the top sub 14*b* and a trip out will yield the junk basket 12. The operator pulls up on the retrieving tool 70, by pulling up on the tubing string. The operator observes the pull force and compares that against the weight of the tubing string. If the pull force climbs significantly, approaching. 2000 lbs. over the weight of the tubing, then it is understood that the combination retrieving tool 70 must have latched onto the junk basket 12. If the operator continues to pull up on the tubing string to approx. 2000 lbs., and then the pull force drops sharply to that of the tubing weight alone, the operator has then confirmed that the junk basket 12 is latched and that the brass screws 59 have sheared, separating the basket 12 from the bridge plug 50 as shown in FIGS. 7*b* and 8.

Figure 8:
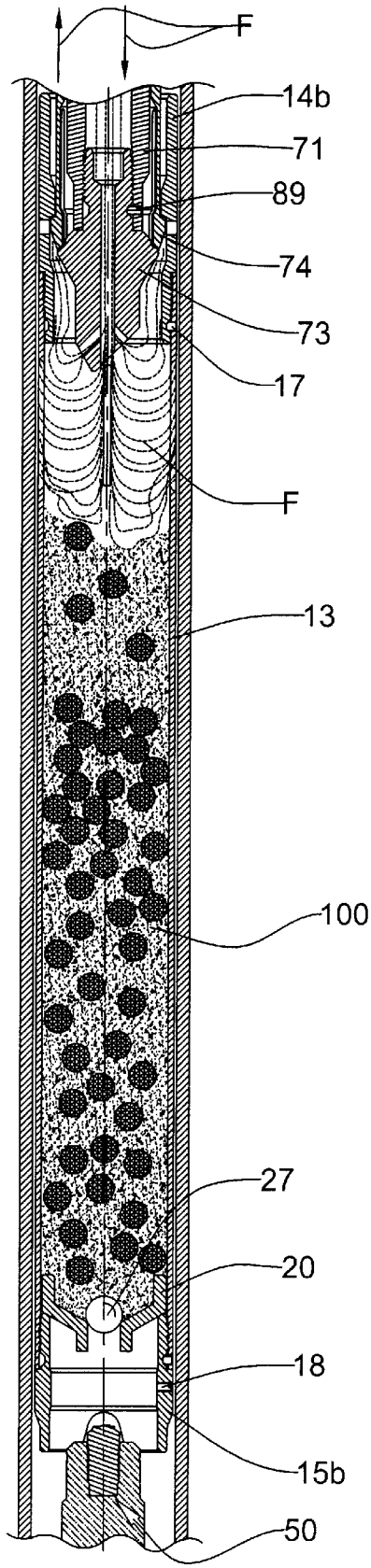
FIG. 8 is a cross-sectional view illustrating the loosened, yet still debris-filled junk basket after shearing from the bridge plug and in the process of being retrieved from the well bore.

As shown in FIG. 8, one of the significant features of the novel junk basket 12 is demonstrated when the brass screws 59 are sheared. Once sheared, the retrieving tool 70 and latched junk basket immediately and quickly lift free of the bridge plug. This lifting action quickly spaces the basket 12 from the plug 50 and removes support from the basket floor 20. Accordingly, the basket floor 20 falls abruptly to the bottom sub's inner shoulder 21 resulting in a sharp increase in the collection volume V. This increase in the collection volume V causes the packed debris 100 to loosen as it expands to fill the greater volume. Surprisingly, the basket is then much easier to retrieve. It is postulated that fine debris, like packed sand, has been loosened in the annulus 102 between the sleeve 13 and the casing 11. While the exact mechanism is not clear, it may be that the falling of the floor acts as a jar, or possible that the sudden increase in volume creates a localized pressure differential and resulting fluid flow between the basket's bore 19 and the basket/casing annulus 102 which appears to loosen the grip any packed sand in the annulus 102. Having loosened the basket 12 in the casing 11, the basket 12 is more readily retrieved without binding.

Lastly, the retrieving tool 70 and junk basket 12 are pulled out of the well bore 10.

To complete the practical aspect of completing the task, the disassembly of the retrieving tool 70 from the junk basket 12 is described as follows. The basket's top sub 14*b* is unscrewed from the sleeve 13. The nozzle 73 is unscrewed from the retrieving tool 70 and the remainder of the retrieving tool 81,80 is slid out of the top sub 14*b*. The collet 87 is removed through the bottom end of the top sub 14*b*. Lastly, the ball 27 and basket floor 20 are removed from the inside of the sleeve 13, and the connection between the sleeve 13 and bottom sub 15*b* is unscrewed.

The embodiment of the invention in which an exclusive property or privilege is claimed are defined as follows:

1. A junk basket for collecting debris for removal from a well bore comprising:

(a) a tubular sleeve which fits within the well bore, the sleeve having a bore extending axially therethrough and having top and bottom ends;

(b) retrieving means formed at the top end of the sleeve adapted for lifting the junk basket from the well bore;

(c) means for substantially blocking the sleeve's bore, said blocking means being axially movable within the sleeve's bore; and (d) a shoulder formed within the sleeve's bore at the sleeve's bottom end capable of supporting the blocking means and preventing its passage downwardly therethrough so that the blocking means are operative between at least two positions being i) a first collection position wherein blocking means is supported and spaced upwardly from the sleeve's bottom end when the junk basket is positioned in the well bore, a collection volume being defined above the blocking means for collecting debris, and ii) a second retrieving position wherein when the junk basket is lifted by the retrieving means, the blocking means is no longer supported so that the blocking means falls to the bottom shoulder for increasing the junk basket's collection volume for the collected debris whereby the collected debris is loosened within the sleeve.

2. The junk basket as recited in claim 1 wherein the blocking means comprises:

(a) a body forming a basket floor which fits closely within the sleeve's bore and has an axial port formed therethrough; and (b) a ball movable within the sleeve's bore and which normally blocks the axial port when seated thereon.

3. The junk basket as recited in claim 2 further comprising supporting means for supporting the basket floor in the first collection position, the supporting means comprising a support member which protrudes axially through the bottom end of the sleeve and engages the basket floor, said protruding means being located in the well bore adjacent and below the junk basket.

4. The junk basket as recited in claim 3 wherein the support member comprises a downhole tool anchored within the well bore and having a top protuberance which supports the basket floor.

5. The junk basket as recited in claim 4 wherein the junk basket is deployable with the downhole tool and a rod connection is formed at the top of the downhole tool, both being deployed using a rod which extends down through the sleeve's bore to connect to the rod connection during deployment and wherein:

(a) an annulus is formed between the rod and the sleeve;

(b) the rod and rod connection connect through the axial port of the basket floor; and (c) the ball is displaced from the basket floor's axial port and into the annulus so that i) when the rod is disconnected from the rod connection and is removed from the sleeve, the protuberance continues to support the basket floor and the ball is poised to block the axial port, prevented only if at all, by the rod connection, and ii) when the junk basket is lifted, the ball seats in the axial port to block the basket floor.

6. The junk basket as recited in claim 5 wherein the rod connection is a shear stud protruding from the top protuberance of the downhole tool which, when sheared, leaves a sheared portion remaining with the downhole tool and the basket floor continues to be supported by the protuberance.

7. The junk basket as recited in claim 6 wherein the retrieving means comprises an internal latch formed in the sleeve for adapting to a retrieving tool which engages the bore of the sleeve.

8. The junk basket as recited in claim 7 wherein an annulus is formed between the sleeve and the well bore, the basket further comprising one or more ports below the basket's retrieving means for permitting fluid communication between the sleeve's bore and the well bore annulus.

9. A method for deploying a retrievable junk basket simultaneously with a downhole tool using an insertion rod, the downhole tool having a top protuberance and rod connection, the method comprising the steps of:

(a) connecting a junk basket to the top of the downhole tool, the junk basket comprising a tubular sleeve having top and bottom ends, an open bore extending axially through from the top end through to the bottom end, and a basket floor which blocks the sleeve's bore, the basket floor having a port therethrough and a port-blocking ball;

(b) releasably connecting the insertion rod to the rod connection through the sleeve's bore and through the port in the basket floor;

(c) inserting the insertion rod, junk basket and downhole tool into the well bore;

(d) anchoring the downhole tool within the well bore;

(e) releasing the insertion rod from the rod connection so that the junk basket remains in the well bore above the downhole tool and the ball can block the port.

10. The basket deploying method as recited in claim 9 wherein the basket floor is axially movable in the bore and a shoulder is formed within the sleeve's bore at the sleeve's bottom end capable of supporting the basket floor and preventing its passage downward therethrough, connection of the basket to the downhole tool further comprises the steps of:

(a) supporting the basket floor upon the top protuberance; and (b) spacing the basket floor upwardly from the sleeve's bottom end for forming a collection volume above the basket floor for collecting debris, said volume being smaller than that formed if the basket floor is supported on the shoulder at the sleeve's bottom end.

11. A method for deploying a retrievable junk basket simultaneously with a downhole tool using an insertion rod, the downhole tool having a top protuberance and rod connection, the method comprising the steps of:

(a) providing a junk basket comprising a tubular sleeve, top and bottom ends, a open bore extending axially through from the top end through to the bottom end, and basket floor which blocks the sleeve's bore, the basket floor being axially movable in the bore and having an axial port extending therethrough and a shoulder formed within the sleeve's bore at the sleeve's bottom end capable of supporting the basket floor and preventing its passage therethrough;

(b) connecting the junk basket to the top of the downhole tool so that the protuberance protrudes up into the sleeve's bottom and bore, supporting and spacing the basket floor from the bottom end;

(c) connecting the insertion rod to the rod connection through the sleeve's bore;

(d) inserting the insertion rod, junk basket and downhole tool into the well bore;

(e) anchoring the downhole tool within the well bore;

(f) separating the insertion rod from the rod connection so that the junk basket remains in the well bore above the downhole tool.

12. The basket deploying method as recited in claim 11 further comprising the steps of:

(a) providing a loose ball located in the sleeve's bore capable of blocking the axial port; and (b) positioning the ball in the sleeve annulus before inserting the junk basket into the well bore so that the ball is available to block the axial port when the insertion rod is separated from the rod connection and removed therefrom.

13. A method for the collection and removal of debris from a well bore comprising the steps of:

(a) providing a bridge plug having a top protuberance protruding uphole from the plug, a rod connection formed in the protuberance, and a junk basket comprising a tubular sleeve having top and bottom ends, a retrieval tool connection and a basket floor axially movable within the sleeve, an axial port being formed through the basket floor;

(b) releasably connecting the junk basket to the plug so that the top protuberance supports and spaces the basket floor upwardly from the sleeve's bottom end and forming a collection volume thereabove, (c) releasably connecting an insertion rod to the rod connection through the sleeve's bore;

(d) inserting the insertion rod, junk basket and plug into the well bore and anchoring the plug within the well bore;

(e) releasing the insertion rod from the rod connection so that the junk basket and plug remains in the well bore and removing the insertion rod from the well bore;

(f) collecting debris within the collection volume of the junk basket;

(g) inserting a retrieving tool into the well bore for connection to the basket's retrieval tool connection;

(h) releasing the basket from the plug;

(i) lifting the basket with the retrieving tool so that the basket floor is no longer supported by the top protuberance and thus falls to the bottom of the sleeve while simultaneously increasing the collection volume in which the debris has been collected; and j) removing the junk basket from the well bore.

14. The method for the collection and removal of debris as recited in claim 13 wherein the basket is connected to the plug with shear pins and is released by lifting the basket until pins are sheared.

15. The method for the collection and removal of debris as recited in claim 14 wherein the rod connection is a shear stud and is released by shearing the stud.

16. The method for the collection and removal of debris as recited in claim 15 wherein the plug is set in the well bore by:

(a) bearing downward against the plug using the bottom end of the basket's sleeve; and (b) restraining the stud until it shears.

17. The method for the collection and removal of debris as recited in claim 16 wherein the plug is set in the well bore using a setting tool for shearing the stud.

18. The method for the collection and removal of debris as recited in claim 17 wherein the debris is capable of passing through the axial port, further comprising the steps of:

(a) providing a ball which is sized for blocking the axial port in the basket floor;

(b) positioning the ball within the sleeve prior to inserting the basket and plug into the well bore so that when lifting the basket with the retrieving tool, the ball blocks the axial port for retaining the debris within the collection volume.

* * * * *